US011986142B2

(12) United States Patent
Oznazli

(10) Patent No.: US 11,986,142 B2
(45) Date of Patent: May 21, 2024

(54) WATER INLET ASSEMBLY AND A WASHING DEVICE COMPRISING SAME

(71) Applicant: Vestel Beyaz Esya Sanayi ve Ticaret Anonim Sirketi, Manisa (TR)

(72) Inventor: Gurkan Oznazli, Manisa (TR)

(73) Assignee: Vestel Beyaz Esya Sanayi ve Ticaret Anonim Sirketi, Manisa (TR)

( * ) Notice: Subject to any disclaimer, the term of this patent is extended or adjusted under 35 U.S.C. 154(b) by 76 days.

(21) Appl. No.: 17/147,275

(22) Filed: Jan. 12, 2021

(65) Prior Publication Data

US 2021/0219810 A1 Jul. 22, 2021

(30) Foreign Application Priority Data

Jan. 17, 2020 (TR) ..... 2020/00700

(51) Int. Cl.
*A47L 15/42* (2006.01)
*A47L 15/48* (2006.01)

(52) U.S. Cl.
CPC ..... *A47L 15/4217* (2013.01); *A47L 15/4234* (2013.01); *A47L 15/483* (2013.01)

(58) Field of Classification Search
CPC ..... A47L 15/4217; A47L 15/4234; A47L 15/483; A47L 15/4246
See application file for complete search history.

(56) References Cited

U.S. PATENT DOCUMENTS 3,717,168 A * 2/1973 Yake ..... A47L 15/4217 134/186
6,349,731 B1 2/2002 Schaaf et al.
7,798,157 B2 * 9/2010 Kim ..... A47L 15/486 134/107
2009/0277481 A1 * 11/2009 Haltmayer ..... A47L 15/4246 134/96.1

FOREIGN PATENT DOCUMENTS

DE 102007063618 A1 * 10/2008 ..... A47L 15/0081

* cited by examiner

*Primary Examiner* — Joseph L. Perrin
*Assistant Examiner* — Irina Graf
(74) *Attorney, Agent, or Firm* — Notaro, Michalos & Zaccaria P.C.

(57) ABSTRACT

An inlet assembly (T) and a washing device (C), particularly a dishwasher, are provided. The inlet assembly (T) comprises at least one body (1) having a first opening (1*a*); a connection area (1*b*) on the body (1), and a hole; a cover assembly (2), at least a part of which is inserted into the body (1) through the first opening (1*a*), and including a cover body (2*a*) closing the first opening (1*a*), a water inlet section (2*b*) extending from one side of the cover body (2*a*), a second opening (2*d*) on the water inlet section (2*b*), allowing air to enter the water inlet section (2*b*), a condensation section (2*e*), formed as a chamber, extending into the body (1), and located on the other part of the cover body (2*a*), and a third opening (2*f*) on a part of the cover body (2*a*) where the condensation section (2*e*) is situated.

7 Claims, 7 Drawing Sheets

WATER INLET ASSEMBLY AND A WASHING DEVICE COMPRISING SAME

CROSS-REFERENCE TO RELATED APPLICATIONS

This application claims priority to Turkish application 2020/00700, filed Jan. 17, 2020, which is hereby incorporated by reference in its entirety.

FIELD OF THE INVENTION

The present invention relates to a water inlet assembly and a washing device comprising same, particularly a dishwasher.

BACKGROUND ART

Today, washing devices that save water and provide ease of drying are used especially for washing kitchen utensils. Said washing devices comprise a housing including at least one lower chamber, at least one inner chamber having at least one access opening, and at least one side panel forming the sides of the said inner chamber; at least one valve located in said lower chamber and one side of which is connected to a water pipe originating from the water mains; at least one water inlet opening situated in the said side panel and allowing water inlet to the inner chamber; at least one connection pipe connected to the other side of the said valve and conveying water to the said water inlet opening; and at least one measuring device, preferably a flow meter, for determining the amount of water that will pass through the said connection pipe. In the said washing devices, especially in dishwashers, water is supplied to the inner chamber at the beginning of each washing and rinsing process so that the kitchen utensils in the inner chamber are washed. However, during the said washing or rinsing process, especially during the water intake into the inner chamber, in case of a reverse pressure, the contaminated water can pass through the contaminated water inlet opening into the said connection pipe and then into the water mains and thus mix into the mains water. This causes contamination of the mains water.

There are various applications in the prior art to solve the above-mentioned problem, one of which is disclosed in U.S. 63/497,3161. Said patent document describes a water inlet assembly that is mounted in a water inlet opening of a dishwasher. Said water inlet assembly is positioned between the said connection pipe and the water inlet opening on the side panel. Said water inlet assembly comprises a housing including a water inlet chamber mounted in the said water inlet opening, at least one venting chamber, at least one vent opening for the outlet of air that is inside the said venting chamber into the dishwasher, and at least one conduit. However, in the said patent document, since the moist air in the venting chamber passes out from the venting opening, the air released into the environment without being dehumidified cannot contribute to the drying process in a sufficient manner.

SUMMARY OF THE INVENTION

The present invention relates to a water inlet assembly and a washing device comprising same, particularly a dishwasher. Said water inlet assembly comprises at least one body in the form of a hollow closed chamber having at least a first opening on at least one side thereof; at least one connection area located on a surface of the body, and including at least one hole; and at least one cover assembly positioned to close the said first opening, at least a part of which is inserted into the body through the first opening, and including: at least one cover body closing the said first opening,

- at least one water inlet section extending from one side of the said cover body, which is located on a part of the cover body, and which is in the form of a chamber,
- at least a second opening located on the said water inlet section and allowing air to enter the interior of the water inlet section,
- at least one condensation section in the form of a chamber, extending into the body from the other side of the said cover body, and located on the other part of the cover body, and
- at least a third opening located on a part of the said cover body where the condensation section is situated.

With the water inlet assembly according to the present invention and the washing device comprising same, an additional passage is provided between the water inlet opening or the inner chamber and the connection pipe so that during the washing and rinsing process, in case of a reverse pressure, the washing liquid in the inner chamber is prevented from reaching directly to the connection pipe and then to the water mains. In this way, contamination of the mains water is prevented. In addition, during a drying process in the washing device, since the steam passing from the inner chamber into the body of the water inlet assembly condenses while being passed through the condensation section and a first conduit and a second conduit in the condensation section, less steam is released from a third opening and also the drying process is faster.

OBJECT OF THE INVENTION

An aim of the present invention is to provide a water inlet assembly, which prevents a leakage of the contaminated water into the connection pipe and then into the water mains due to a reverse pressure that occurs during or after the water intake for washing and rinsing processes in washing devices, especially in dishwashers, and a washing device comprising same.

Another object of the present invention is to provide a water inlet assembly which increases the drying performance of the washing device by preventing a release of the steam, and a washing device comprising same.

Another object of the present invention is to provide a water inlet assembly with a long service life and minimum maintenance/repair cost, and a washing device comprising same.

DESCRIPTION OF THE DRAWINGS

Embodiments of a water inlet assembly according to the present invention and a washing device comprising same are illustrated in the accompanying drawings, in which.

Figure 1:
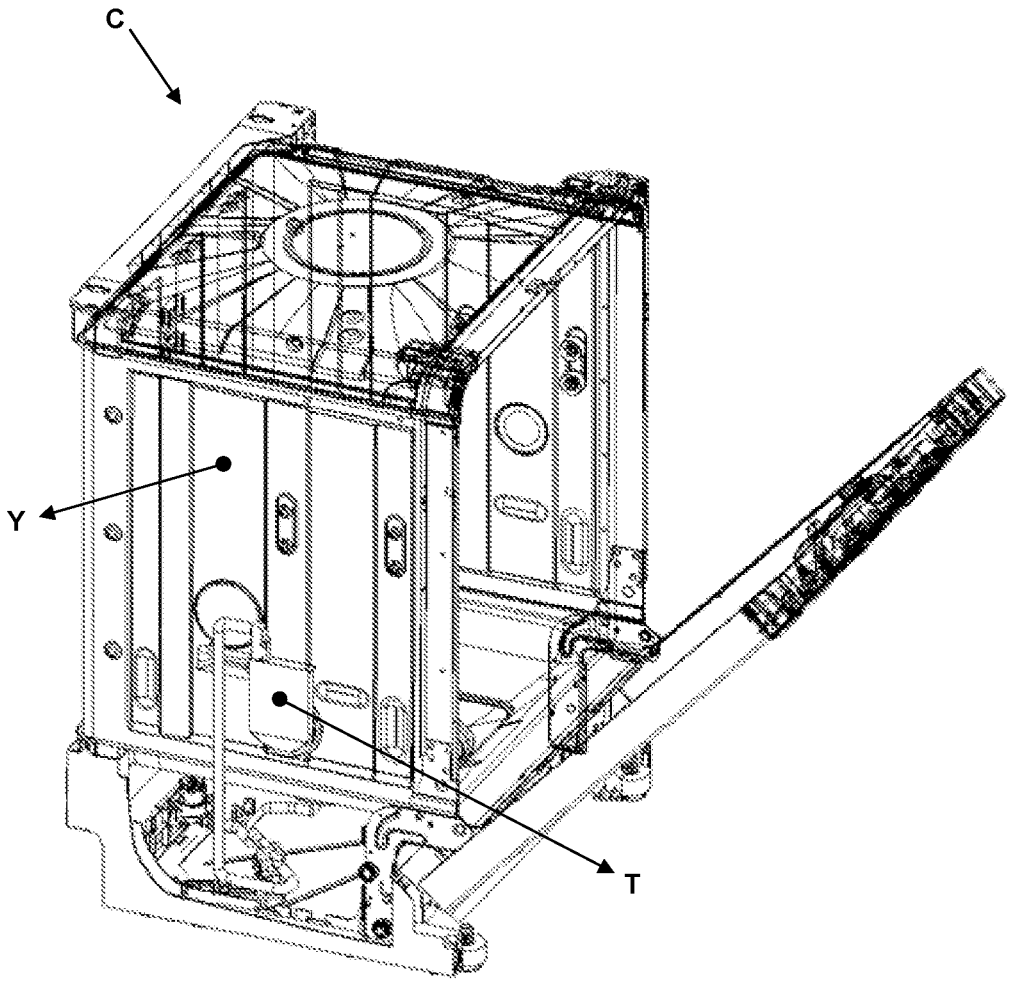
FIG. 1 is a side perspective view of a washing device in which a water inlet assembly of the invention is applied.
Figure 2:
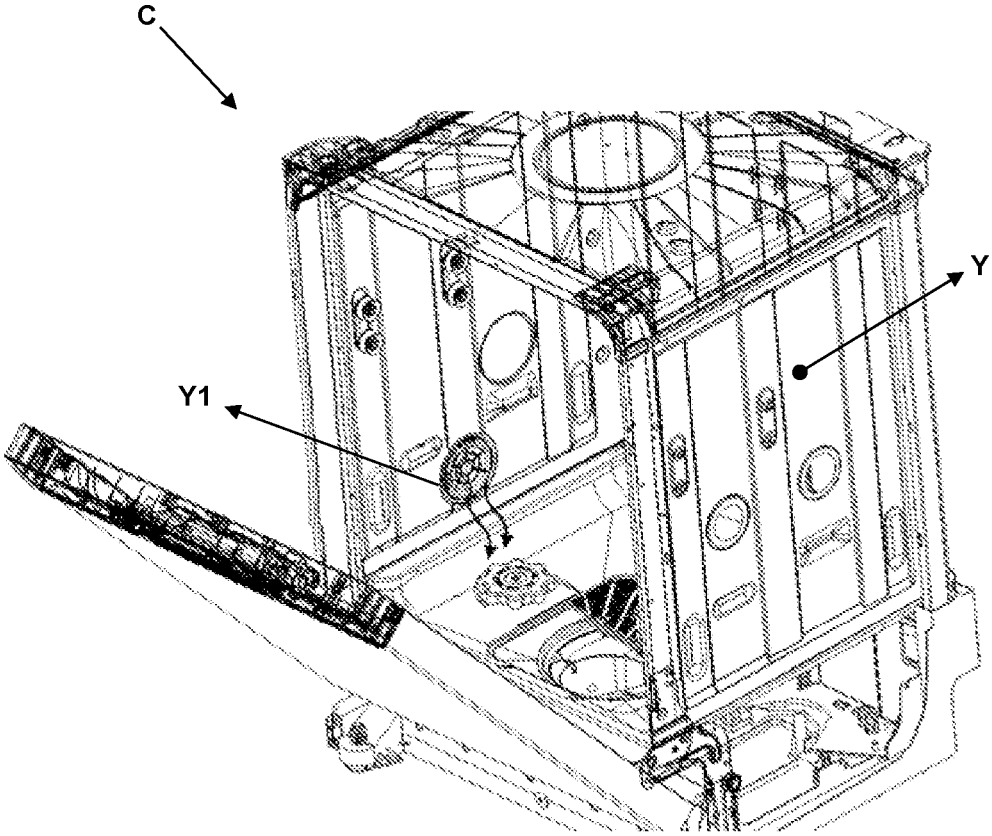
FIG. 2 is a perspective view showing an inner chamber of a washing device in which the water inlet assembly of the invention is applied.
Figure 3:
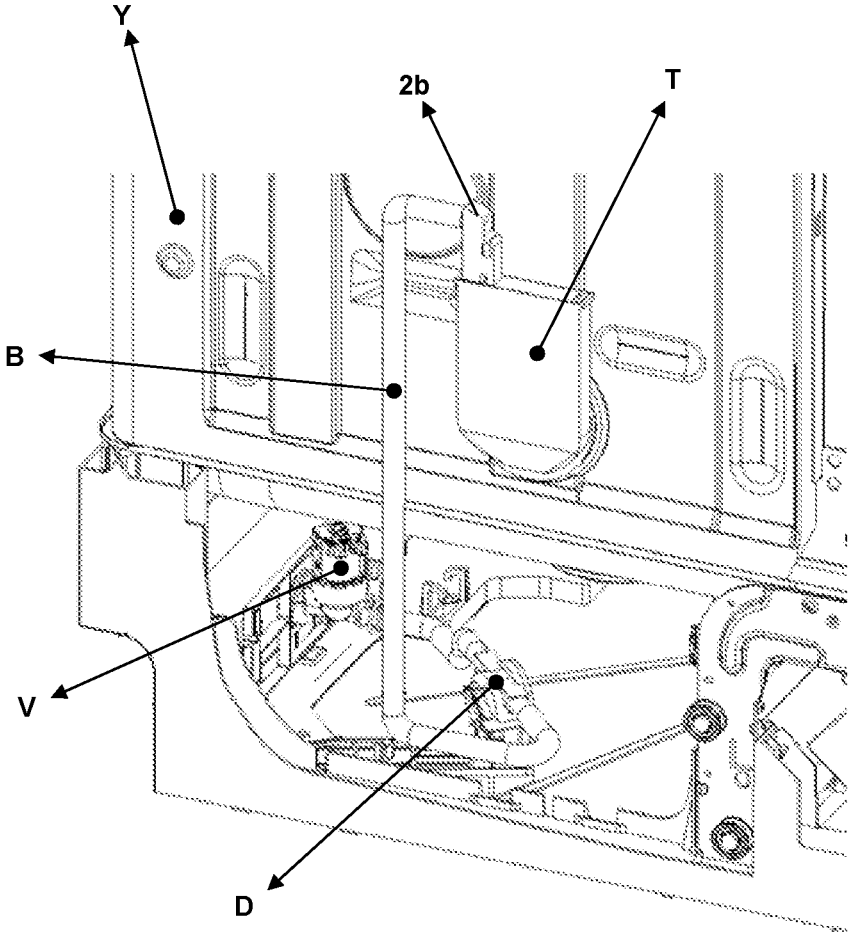
FIG. 3 is a detailed view of a part of a washing device in which the water inlet assembly of the invention is applied, where the water inlet assembly is attached.
Figure 4:
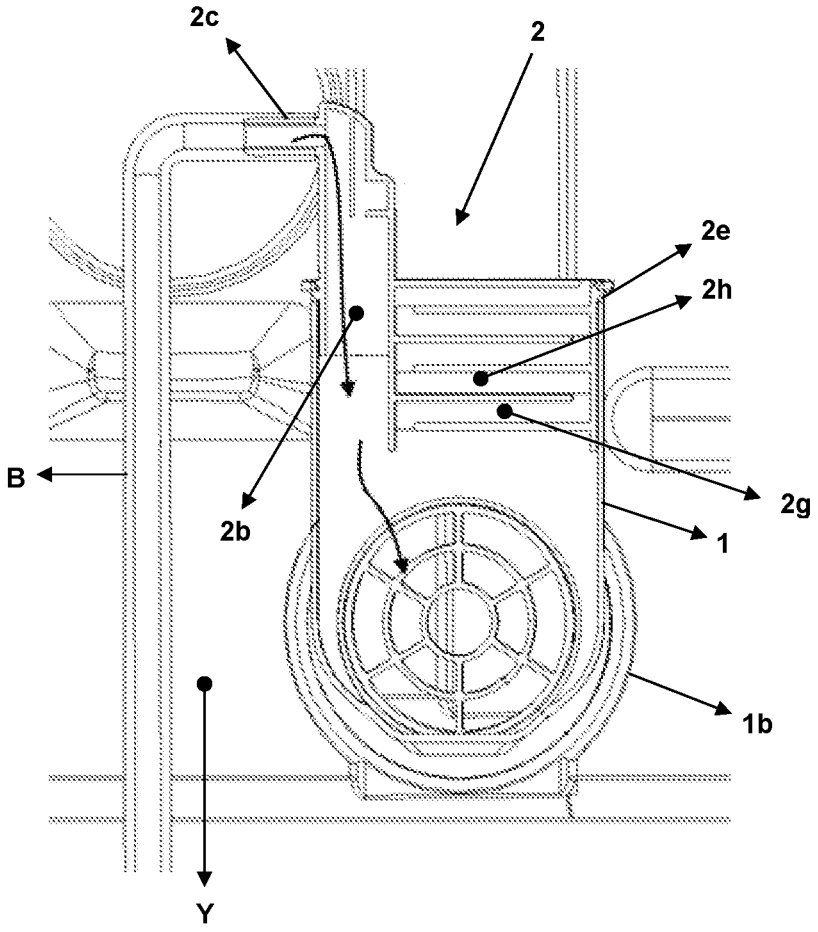
FIG. 4 is a sectional view showing the water flow direction during the use of a washing device in which the water inlet assembly of the invention is applied.
Figure 5:
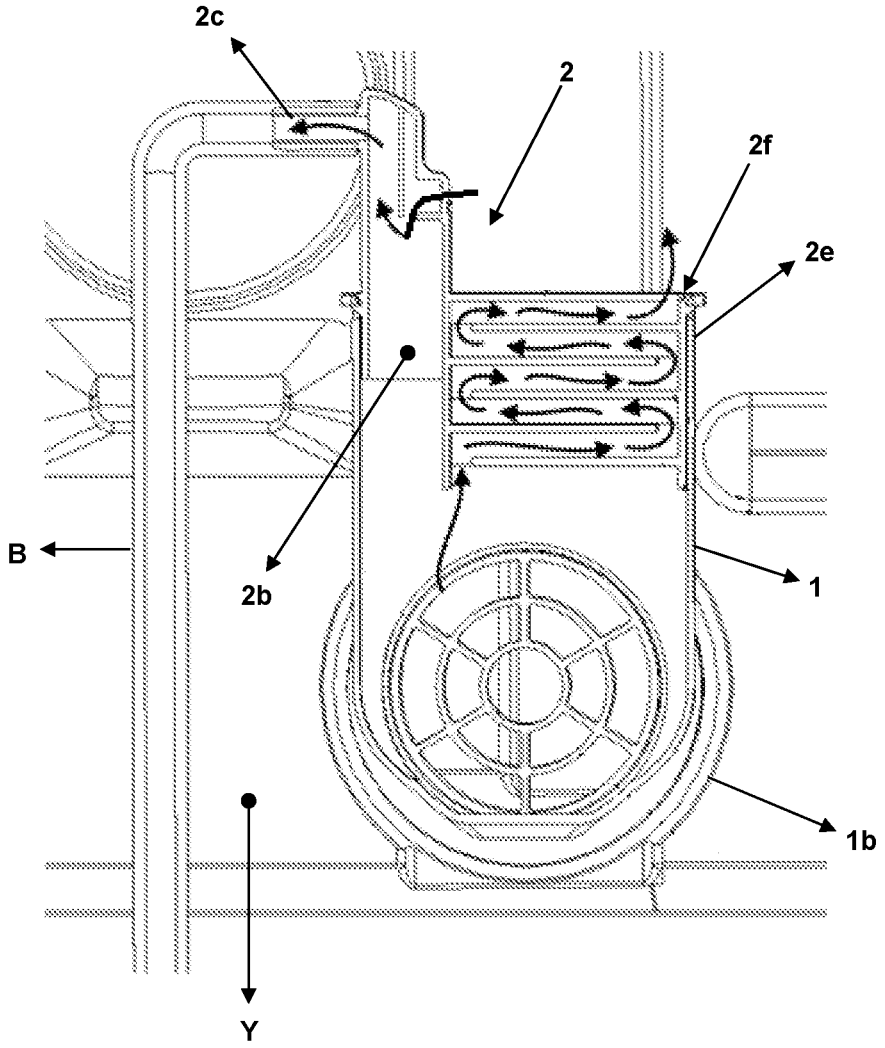
FIG. 5 is a cross-sectional view showing air and steam flow directions during the use of a washing device in which the water inlet assembly of the invention is applied.

The parts in the drawings are individually assigned a reference numeral and the equivalents of these numbers are given follow:

Washing device (C)
Side panel (Y)
Water inlet hole (Y1)
Connection pipe (B)
Measuring device (D)
Valve (V)
Water inlet assembly (T)
Body (1)
First opening (1*a*)
Connection area (1*b*)
Cover assembly (2)
Cover body (2*a*)
Water inlet section (2*b*)
Connection member (2*c*)
Second opening (2*d*)
Condensation section (2*e*)
Third opening (20
First conduit (2*g*)
Second conduit (2*h*)

DESCRIPTION OF THE INVENTION

The washing devices that save water and offer ease of drying, especially dishwashers, comprise a housing including at least one lower chamber, at least one inner chamber in which cleaning operations are performed, and at least one side panel forming at least one side of the said inner chamber; at least one valve located in the said lower chamber and one side of which is connected to a water pipe originating from a source (e.g. the water mains); at least one water inlet opening situated in the said side panel and allowing water inlet to the inner chamber; at least one connection pipe connected to the other side of the said valve and conveying water to the said water inlet opening; and preferably at least one measuring device for determining the amount of water that will pass through the said connection pipe. In the said washing devices, during the washing or rinsing process, contaminated water may pass through the water inlet opening into the said connection pipe and then into the said water mains, due to a reverse pressure. This causes the mains water to be contaminated, thereby resulting in a washing and/or rinsing process to be carried out with contaminated water. Accordingly, the present invention provides a water inlet assembly for solving said problems, which prevents a leakage of the contaminated water into the connection pipe and then into the water mains due to a reverse pressure that occurs during or after the water intake for washing and rinsing process, and which increases the performance of the drying, as well as a washing device comprising same.

Figure 6:
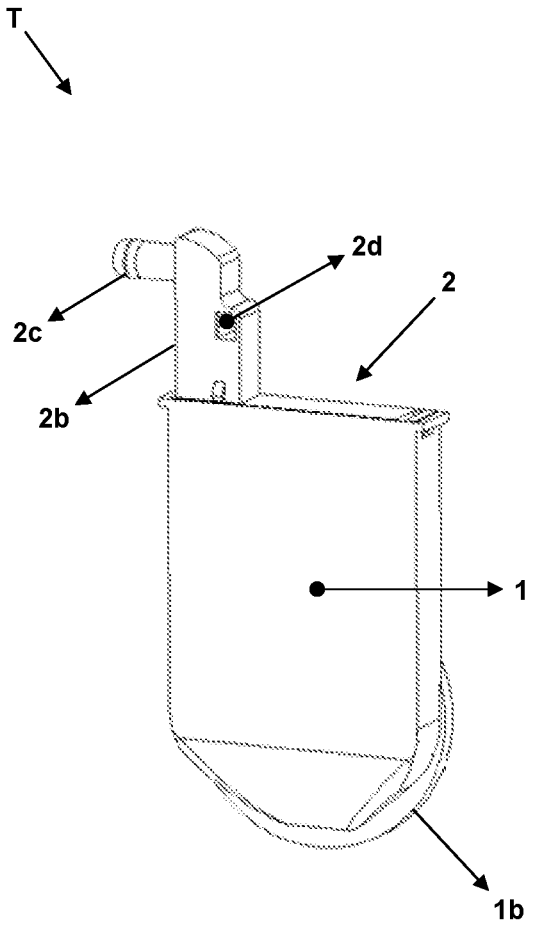
FIG. 6 is a perspective view of the water inlet assembly of the invention.
Figure 7:
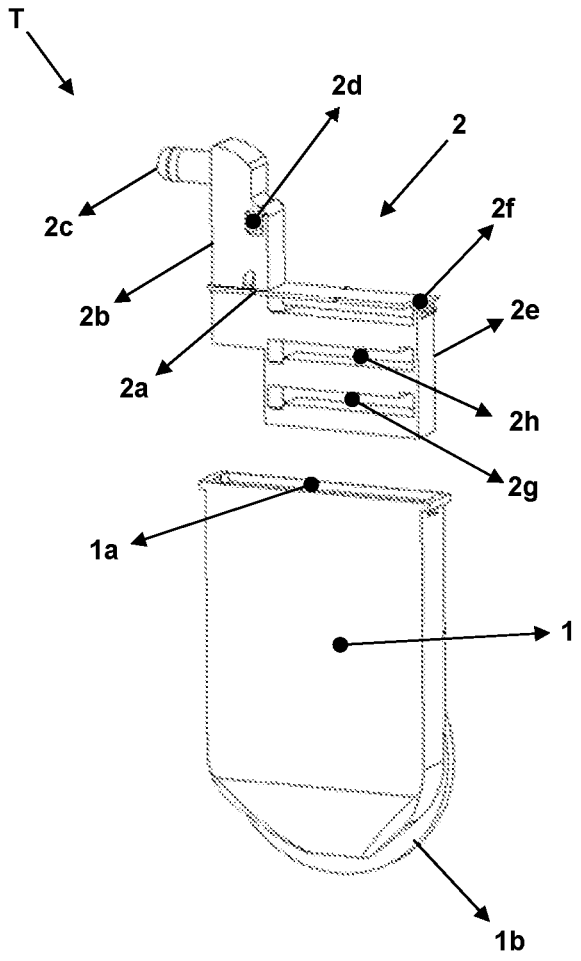
FIG. 7 is a perspective view of a semi-assembled state of the water inlet assembly of the invention.

The water inlet assembly (T) of the present invention, whose exemplary views are illustrated in FIGS. 6 and 7, comprises at least one body (1) in the form of a hollow closed chamber, and preferably in the form of a polygon, having at least a first opening (1*a*) on at least one side thereof; at least one connection area (1*b*) located on a surface of the body (1) (preferably, a surface substantially perpendicular to the surface where the first opening (1*a*) is located), and including at least one hole; and at least one cover assembly (2) positioned to close the said first opening (1*a*), at least a part of which is inserted into the body (1) through the first opening (1*a*), and including:

at least one cover body (2*a*) closing the said first opening (1*a*), at least one water inlet section (2*b*) extending from one side of the said cover body (2*a*), e.g., from a side of the said cover body (2*a*) remaining above the first opening (1*a*), which is located on a part of the cover body (2*a*), and which is in the form of a chamber, at least a second opening (2*d*) located on the said water inlet section (2*b*) and allowing air to enter the interior of the water inlet section (2*b*), at least one condensation section (2*e*) in the form of a chamber extending from the other side of the said cover body (2*a*) into the body (1), e.g., from a side of the said cover body (2*a*) facing the interior of the first opening (1*a*) (the interior of the body (1)), and which is located in another part of the cover body (2*a*) (e.g., the part where the water inlet section (2*b*) is absent), and at least a third opening (20 located on a part of the said cover body (2*a*) where the condensation section (2*e*) is situated.

In an alternative embodiment, said condensation section (2*e*) preferably comprises at least a first conduit (2*g*) extending substantially linearly and at least a second conduit (2*h*) located parallel to the said first conduit (2*g*) and extending substantially linearly. Said first conduit (2*g*) comprises at least a first inlet and at least a first outlet located at opposite ends of the first conduit (2*g*) (i.e., the first inlet is located at one end of the first conduit (2*g*) and the first outlet is located at the other end of the first conduit (2*g*)). Said second conduit (2*h*) comprises at least a second inlet and at least a second outlet located at opposite ends of the second conduit (2*h*) (i.e., the second inlet is located at one end of the second conduit (2*h*) and the second outlet is located at the other end of the second conduit (2*h*)). The second inlet of the said second conduit (2*h*) is located on the same side as the first outlet of the said first conduit (2*g*), preferably at least partially overlapping with the first outlet.

In a preferred alternative embodiment of the invention, said cover assembly (2) comprises at least one connection member (2*c*), an end of which is connected to the water inlet section (2*b*) and the two ends of which are spaced so as to provide access to the said water inlet section (2*b*), i.e., being in the form of a pipe.

In an alternative preferred embodiment of the invention, said water inlet section (2*b*) comprises a wall separating a part where the said second opening (2*d*) is located.

A washing device (C) (for example, a dishwasher) according to the present invention, whose exemplary views are given in FIGS. 1-5, comprises at least one housing including at least one lower chamber, at least one inner chamber in which cleaning operations are performed, and at least one side panel (Y) forming at least one side of the said inner chamber; at least a valve (V) located in the said lower chamber and one side of which is connected to a water pipe conveying water from a source (e.g. the water mains); at least one water inlet opening (Y1) located in said side panel (Y) and allowing water intake to the inner chamber; and at least a connection pipe (B) which is connected to the other side of the said valve (V) and conveying the water coming from the water pipe and passing through the valve (V) into the said water inlet opening (Y1), and the washing device (C) of the invention also comprises the said water inlet assembly (T) comprising the said body (1) allowing the connection between the said water inlet opening (Y1) and the connection pipe (B) and including the said first opening (1*a*); the said connection area (1*b*) allowing the connection of the body (1) to the water inlet opening (Y1), and conveying the water transferred into the body (1) through the said connection pipe (B), into the inner chamber via the water inlet opening (Y1); and a cover assembly (2), at least a part of which is inserted into the body (1) through the said first opening (1*a*) and including:

the said cover body (2*a*) for closing the first opening (1*a*), the said water inlet section (2*b*), a part of which extending from an upper side of the cover body (2*a*) and away from the body (1), and the other part of which is located at the lower part of the cover body (2*a*) such that it is inside the body (1), which is connected to the said connection pipe (B) at that part remaining on the upper side of the cover body (2*a*), and which conveys the water coming from the source to the connection pipe (B), into the body (1), the said second opening (2*d*) located in the water inlet section (2*b*), and preventing the washing liquid in the inner chamber to be passed through the water inlet section (2*b*) into the said connection pipe (B) and then into the water mains, in case of a reverse pressure during the washing and rinsing processes, by allowing air to enter the water inlet section (2*b*), and— the said condensation section (2*e*) allowing the steam that remains in the body (1) once the said cover body (2*a*) is inserted to the first opening (1*a*), and the steam that is formed in the inner chamber especially during the drying process to be condensed after being passed through the water inlet opening (Y1) and the connection area (1*b*), so as to be converted into water, and thus reducing the amount of steam coming out of the said third opening (20 in the said cover body (2*a*).

With the said water inlet assembly (T), an additional passage is provided between the water inlet opening (Y1) or the inner chamber and the connection pipe (B). This prevents the contaminated water from reaching directly to connection pipe (B) in case of a reverse pressure during the washing and rinsing process.

In an alternative preferred embodiment of the invention, said washing device (C) comprises at least one measuring device (D), preferably a flow meter, that determines the amount of water that will pass through the said connection pipe (B).

In an alternative preferred embodiment of the invention, the condensation section (2*e*) of the said water inlet assembly (T) comprises the said first conduit (2*g*) where the steam passing from the water inlet opening (Y1) into the body (1) during the drying process of the said washing device (C) is passed through the said first inlet into the first outlet, and the said second conduit (2*h*) where it is passed through the first outlet into the second inlet and passed through the said second inlet into the second outlet. Thus, the steam passing from the inner chamber into the body (1) of the water inlet assembly (T) during the drying process condenses as it is being passed through the first conduit (2*g*) and the second conduit (2*h*) and is converted into water, which is returned to the inner chamber so as to be removed by means of a drainage system in the washing device (C). In this way, the drying process is carried out in a faster manner.

In an alternative preferred embodiment of the invention, the water inlet section (2*b*) of the said water inlet assembly (T) comprises the said wall separating a part where the second opening (2*d*) is located, so as to prevent water from leaving the said second opening (2*d*) during the water intake. Thus, during the water intake from the water inlet section (2*b*), the water is just directed inside the body (1) and does not leave the second opening (2*d*).

With the water inlet assembly (T) according to the present invention and the washing device (C) comprising same, an additional passage is provided between the water inlet opening (Y1) or the inner chamber and the connection pipe (B) so that during the washing and rinsing process, in case of a reverse pressure, the washing liquid in the inner chamber is prevented from reaching directly to the connection pipe (B) and then to the water mains. In this way, contamination of the mains water is prevented. In addition, during the drying process in the washing device (C), since the steam passing from the inner chamber into the body (1) of the water inlet assembly (T) condenses while being passed through the condensation section (2*e*) and the first conduit (2*g*) and the second conduit (2*h*) in the condensation section (2*e*), less steam is released from the third opening (2*f*) and also the drying process is faster.

The invention claimed is:

1. A water inlet assembly (T) comprising a body (1) in the form of a hollow closed chamber having a first opening (1*a*) on a top side thereof; and a connection area (1*b*) located on a surface of the body (1), and including a hole in the surface of the body for fluid connection with a washing device; a cover assembly (2) positioned to close the first opening (1*a*), in communication with the body (1) through the first opening (1*a*), the cover assembly (2) including:

a cover body (2*a*) closing the first opening (1*a*), a water inlet section (2*b*) forming a chamber extending from one side of the cover body (2*a*), a second opening (2*d*) located on the water inlet section (2*b*) and allowing air to enter an interior of the water inlet section (2*b*), a condensation section (2*e*) in the form of a chamber, extending downward into the body (1) from a second side of the cover body (2*a*), and a third opening (2*f*) located on the cover body (2*a*) where the condensation section (2*e*) is situated, wherein the condensation section (2*e*) comprises a first conduit (2*g*) that is elongated and extends substantially linearly perpendicular to a direction of gravity and a second conduit (2*h*) that is elongated and extends linearly, the second conduit having a first end and a second end, the second conduit positioned parallel to the first conduit (2*g*) and above the first conduit, the second conduit fluidly connected to the first conduit, wherein the condensation section is configured to condense moist air that flows upwards from the hollow closed chamber, first through the first conduit (2*g*) and then through the second conduit (2*h*) before exiting the condensation section (2*e*).

2. The water inlet assembly of claim 1, wherein said first conduit (2*g*) comprises a first inlet and at least a first outlet located at the opposite ends of the first conduit (2*g*).

3. The water inlet assembly of claim 1, wherein said second conduit (2*h*) comprises a second inlet and a second outlet located at the opposite ends of the second conduit (2*h*).

4. The water inlet assembly of claim 1, wherein said cover assembly (2) comprises a connection member (2*c*) having a first end and a second end, the first end is connected to the water inlet section (2*b*), and the first and second ends are spaced to provide access to the said water inlet section (2*b*).

5. The water inlet assembly of claim 1 for use in a washing device (C) for providing washing and rinsing processes, the washing device (C) having a housing including a lower chamber, an inner chamber in which washing and rinsing processes are performed, a side panel (Y) forming one side of the inner chamber; a valve (V) located in the lower chamber connected to a water pipe conveying water from a source; a water inlet opening (Y1) located in the side panel (Y) providing water intake to the inner chamber; and a connection pipe (B) connected to the valve (V) and conveying water coming from the water pipe and passing through the valve (V) into the water inlet opening (Y 1) wherein the condensation section (2*e*) converts steam into water, reducing steam at the third opening (2*f*) in the cover body (2*a*).

6. The water inlet assembly of claim 5, wherein steam is passed through the first conduit (2*g*) and the second conduit (2*h*).

7. The water inlet assembly of claim 5, wherein the second opening (2*d*) prevents the water in the inner chamber to be passed through the water inlet section (2*b*) to the connection pipe (B), in case of a reverse pressure during the washing and rinsing processes, by allowing air to enter the water inlet section (2*b*).

* * * * *